United States Patent [19]

Wein

[11] Patent Number: 4,953,707

[45] Date of Patent: Sep. 4, 1990

[54] BOX WITH POURING SPOUT

[76] Inventor: Sam Wein, 5061 Aegina Way, Oceanside, Calif. 92056

[21] Appl. No.: 374,739

[22] Filed: Jul. 3, 1989

[51] Int. Cl.[5] ..... B65D 5/54

[52] U.S. Cl. ..... 206/621.4; 206/621.6; 206/626

[58] Field of Search ..... 206/621.3, 621.4, 621.6, 206/621.7, 626, 631.2

[56] References Cited

U.S. PATENT DOCUMENTS

| | | | |
|---|---|---|---|
| 1,286,038 | 11/1918 | Lowy | 229/125 |
| 2,459,130 | 1/1949 | Jones | 206/626 |
| 3,096,921 | 7/1963 | Graybill | 206/621.7 |
| 3,096,922 | 7/1963 | Graybill | 229/17 |
| 3,187,977 | 6/1965 | Graybill | 229/17 |
| 3,187,978 | 6/1965 | Graybill | 229/17 |
| 3,266,055 | 8/1966 | Graybill | 229/17 |
| 4,142,635 | 3/1979 | Capo et al. | 206/621.7 |
| 4,706,875 | 11/1987 | Blackman | 206/626 |

FOREIGN PATENT DOCUMENTS

| | | | |
|---|---|---|---|
| 606816 | 10/1960 | Canada | 206/621.3 |
| 730539 | 3/1966 | Canada | 206/621.3 |
| 565842 | 11/1944 | United Kingdom | 206/621.3 |
| 925975 | 5/1963 | United Kingdom | 206/621.3 |
| 1353079 | 5/1974 | United Kingdom | 206/621.3 |
| 2045723 | 11/1980 | United Kingdom | 206/621.3 |

*Primary Examiner*—Gary E. Elkins

*Attorney, Agent, or Firm*—Richard F. Carr; Richard L. Gausewitz; Allan Rothenberg

[57] ABSTRACT

A box is provided having opposite end panels, one of which is defined by two layers, one inside the other, the outer layer including a closure flap and cutout beneath it, the inner layer including an inner closure flap, the upper portion of which is attached to the outer closure flap and which is bendable transversely beneath the attachment to the outer closure flap, the outer closure flap having a bottom edge retaining the bottom edge of said inner closure flap. A third layer inwardly of the second layer has an opening covered by the closure flaps. In one embodiment, a fourth layer, also with an opening, is provided.

23 Claims, 4 Drawing Sheets

FIG. 1.
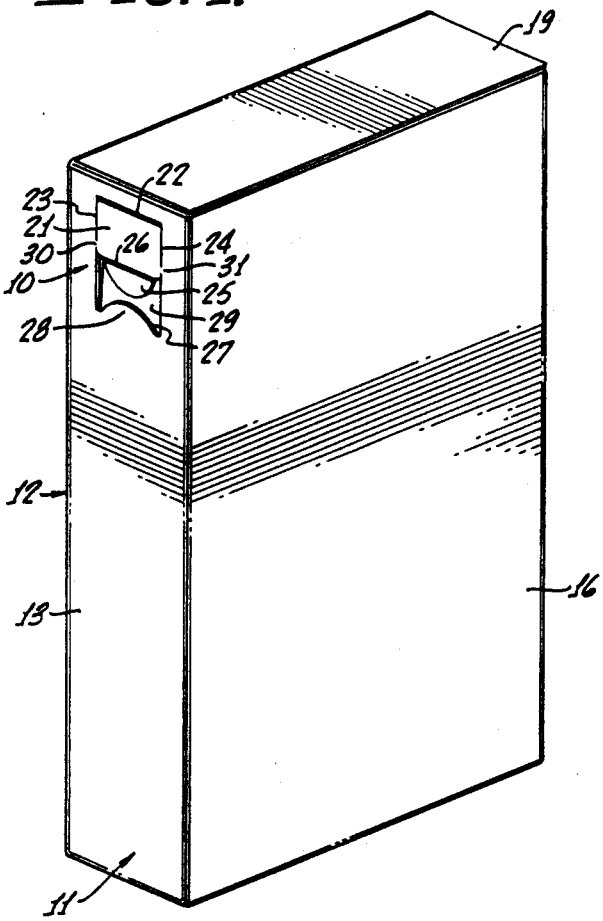
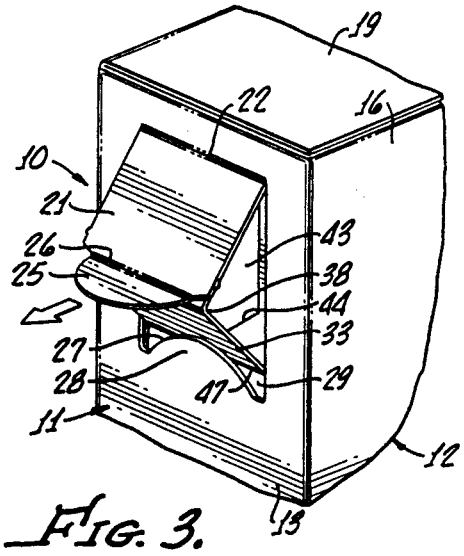
FIG. 3.
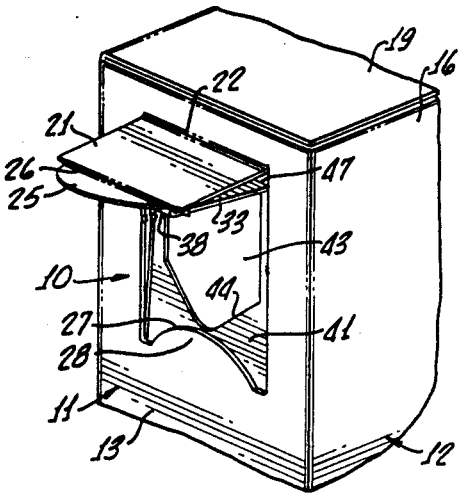
FIG. 4.
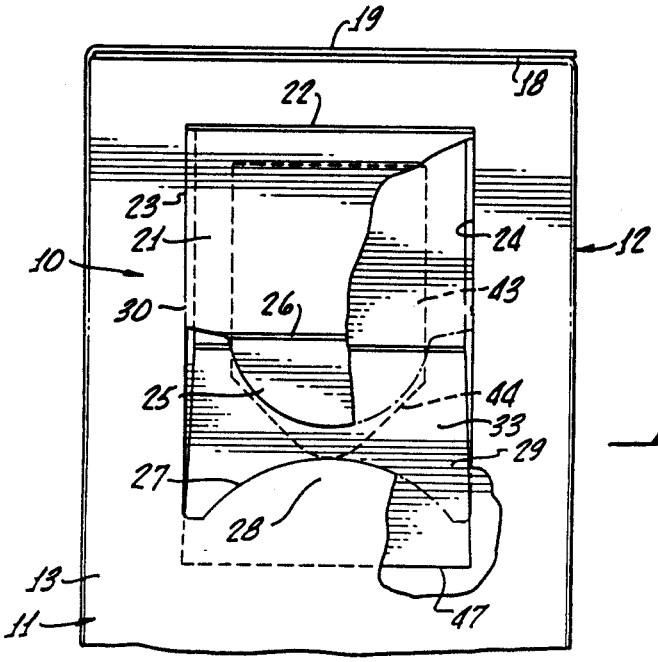
FIG. 2.

FIG. 9.
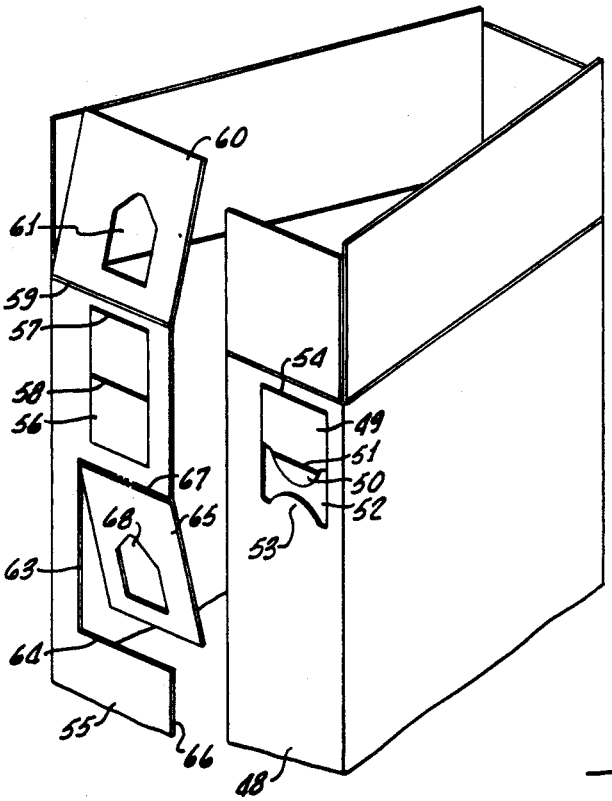
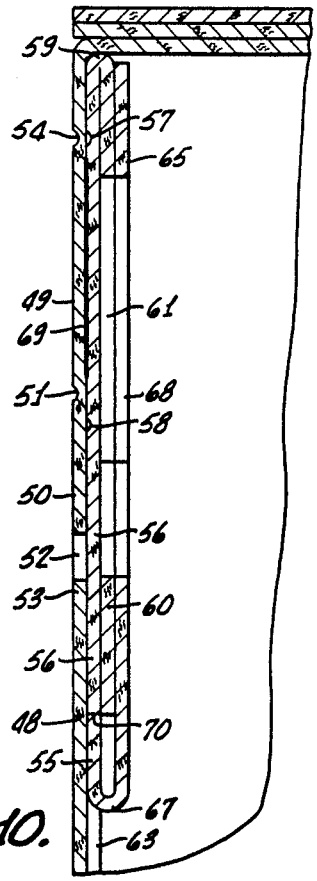
FIG. 10.
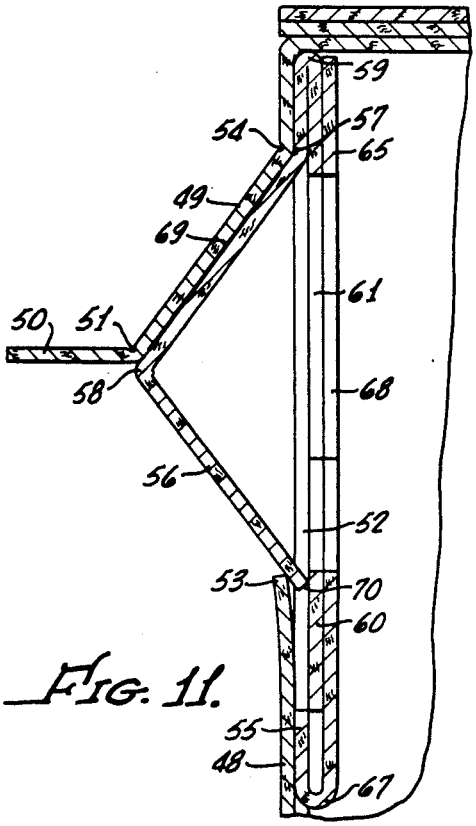
FIG. 11.
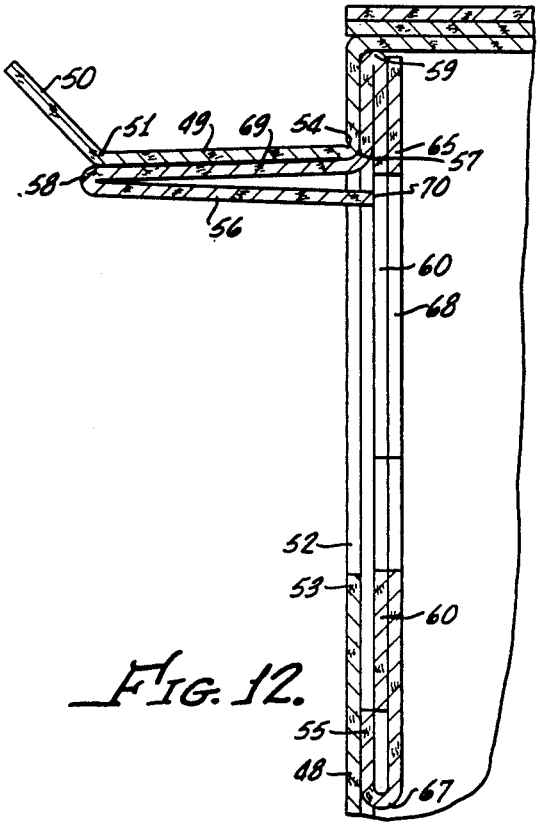
FIG. 12.

BOX WITH POURING SPOUT

Background of the Invention

Although many pouring spout arrangements have been devised in the past, very few have gained commercial acceptance. One of these is a metal spout attached to the end panel of a cardboard box and covered with paper for sealing prior to the opening of the spout. This type spout is effective but is expensive. A recent design provides a plastic spout in the top of a box, again requiring the attachment of a separate element and being costly to produce. Alternatively, many boxes for pourable materials include merely a perforated segment intended to be pushed inwardly to provide a crude opening through which the contents may be dispensed. These are awkward to manipulate, are difficult to pour from and cannot be closed after they have been opened.

Many spout designs cannot be made so as to seal against the leakage of liquids or prevent the sifting through of fine powders.

Consequently, there has been a need for an improved, economical pouring spout for cardboard boxes.

Summary of the Invention

The present invention provides an improved pouring spout arrangement which requires virtually no added expense in producing a cardboard box. No auxiliary elements are necessary. Nevertheless, the spout will effectively seal the contents of the container, provides for the easy pouring of the material from the box and can be closed once the material has been dispensed. This spout arrangement provides for an exceptionally large opening which is important for materials that tend to form lumps, such as detergents.

The spout arrangement provides a cardboard box made from a single sheet of material defining two opposite end panels, one of which has two layers, positioned one on top of the other. The outer layer includes a cutout for a portion of the closure flap, pivotal about its upper edge with an opening beneath it. The inner layer has a remainder of the closure flap which is pivotal about its upper edge and bendable transversely at its intermediate portion. Above the bendable portion it is attached to the outer portion of the closure flap. The bottom edge of the inner closure flap fits inside the projecting central portion of the bottom edge of the opening in the outer panel. A third layer is provided by a flap on the inner layer which is doubled over and provided with an opening in back of the closure flaps.

The box is opened by pulling outwardly on the closure flaps to pivot them about the upper edges. This removes the bottom closure flap from inside of the opening and causes it to bend transversely, uncovering the openings through the end panel of the box. The closure flaps may be retained in the opened position by locating the bottom edge of the closure flap adjacent the pivot point of the closure flap bearing, against the wall of the third panel on either side of the opening. Therefore, it is unnecessary to hold the pouring spout open manually as the contents of the box are being dispensed.

The spout is closed by reversing the operation and inserting the bottom edge of the closure flap inside the lower edge of the cutout in the outer panel.

In one embodiment, four layers are provided for extra strength and rigidity. The fourth layer is cut from the inner portion of the end panel and doubled over. The fourth layer is provided with an opening in registry with the other openings so that material may be dispensed through it.

A waterproof or siftproof design may be provided by cutting partially through the third layer from opposite sides so as to leave a narrow strip between the cuts. The center portion within these cuts remains in place and is secured to the closure flap. Movement of the closure flap in opening the spout tears the material in the third layer along the narrow strip to remove the center portion from within the cuts and open the spout. Until this time, however, there is no communication through the third layer because the cuts are formed from either side and are spaced from each other.

Brief Description of the Drawings

FIG. 1 is a perspective view of a box incorporating the spout of this invention;

FIG. 2 is an enlarged elevational view, partially broken away, of the spout;

FIG. 3 is a fragmentary perspective view of the spout in a partially opened condition;

FIG. 4, is a view similar to FIG. 3 but with the spout open;

FIG. 9 is a fragmentary perspective view of a partially assembled box incorporating a modified spout arrangement;

FIG. 10 is an enlarged fragmentary sectional view of the spout of FIG. 9, as completed;

FIG. 11 is a view similar to FIG. 10, with the spout partially opened;

FIG. 12 is a view similar to FIGS. 10 and 11, with the spout in the open position;

Detailed Description of the Invention

Figure 5:
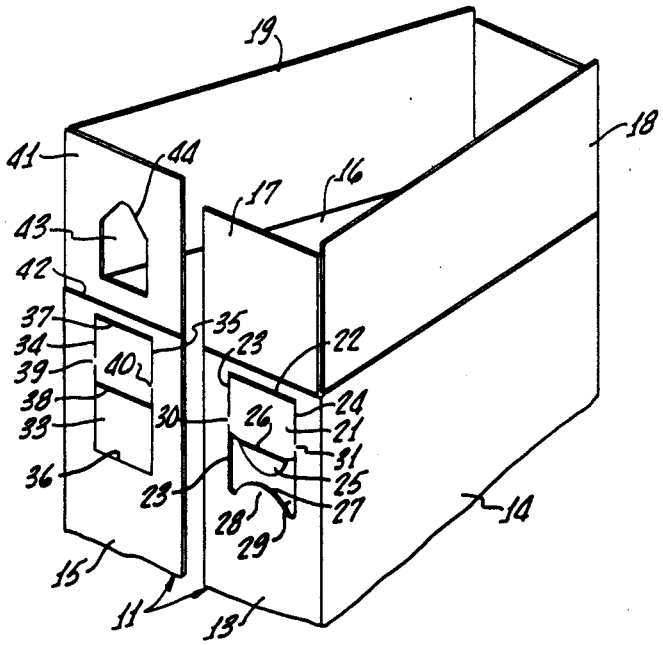
FIG. 5 is a fragmentary perspective view of the box of FIG. 1 in a partially assembled condition.
Figure 6:
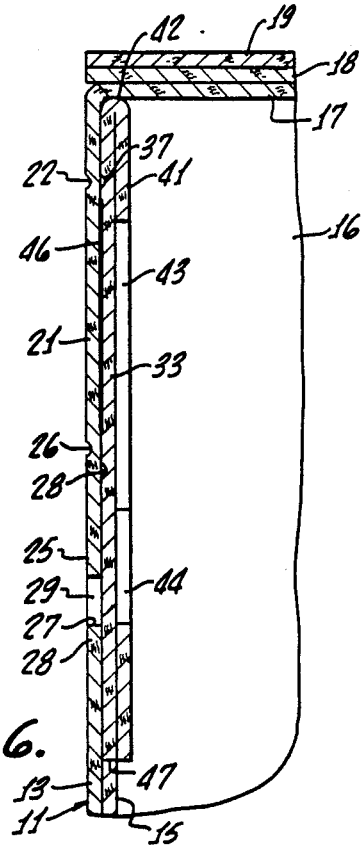
FIG. 6 is an enlarged sectional view of the spout.

The spout arrangement 10 of FIGS. 1 through 8 is positioned in the end panel 11 of a rectangular box 12. As may be seen in FIG. 5, where the box is partially assembled, the box is made up of a single sheet of cardboard that includes two layers at the end panel 11. The outer layer 13 connects to one side panel 14 and the inner end panel 15 connects to the opposite side panel 16. A dust flap 17 projects from the upper end of the panel 13 and fits beneath the two top flaps 18 and 19 in the completed box. Of course the box also includes a bottom panel, not shown.

The outer portion 21 of the closure flap for the spout 10 is formed in the outer panel 13. The flap 21 is pivotal about a reverse score 22 at the upper end of the flap 21 and transverse to the outer end panel 13. Two vertical cuts 23 and 24 extend longitudinally of the panel 13 from the opposite ends of the score 22. The bottom edge of the flap 21 includes a downwardly projecting central tab 25 with a convex arcuate outer edge. A score 26 extends transversely of the flap 21 at its connection to the tab 25. The longitudinal cuts 23 and 24 continue beneath the outer closure flap 21 and are interconnected at their lower ends by a cut 27 which is convex so as to provide a tab 28 facing the tab 25 of the outer closure flap 21. These cuts result in an opening 29 through the end panel 13 beneath the closure flap 21. The two longitudinal cuts 23 and 24 are interrupted by small uncut segments or nicks 30 and 31 located just above the transverse score 25. This holds the flap 21 in a closed position.

The inner part 33 of the closure flap is formed in the inner end panel 15. The flap 33 is generally rectangular, defined by side cuts 34 and 35 extending longitudinally of the panel 15 and a bottom transverse cut 36 that interconnects the lower ends of the cuts 34 and 35. A reverse score 37 extends between the cuts 34 and 35 at the upper end of the inner closure flap 33. At the mid-portion of the inner closure flap 33 is a transverse score 38 that extends between the cuts 34 and 35. Small uncut nicks 39 and 40 interrupt the cuts 34 and 35 above the transverse score 38. The cuts 34 and 35 are parallel above the score 38, but diverge slightly below the score 38 to the bottom transverse cut 36.

A flap 41, generally comparable in size to the dust flap 17, connects to the upper end of the inner end panel 15. A transverse score 42 is formed at the juncture of the inner end panel 15 and the flap 41. An opening 43, narrower and shorter than the inner closure flap 33, is formed in the flap 41. It is preferred to make the edge 44 at the upper end of the opening 43 in the position of FIG. 5 generally V-shaped.

In the completed box, the flap 41 is bent at the score 42 so as to be doubled over the upper end part of the inner end panel 15. Glue along the side edges of the flap 41 and the end panel 15 connect these two elements together. In addition, the inner end panel 15 fits inside of the outer end panel 13 and these two are glued together by strips of glue along their side edges. When this is done, the outer closure flap 21 is super-imposed on the upper part of the inner closure flap 33. These two closure flaps are secured together by a quantity of glue 46 above the scores 26 and 38 and beneath the scores 22 and 37. The opening 43 is in registry with the two closure flaps 21 and 33, as best seen in FIG. 2, with its convergent end edge 44 facing downwardly. The lower end of the edge 44 is at the height of the upper edge of the tab 28 of the outer end panel 13.

Figure 7:
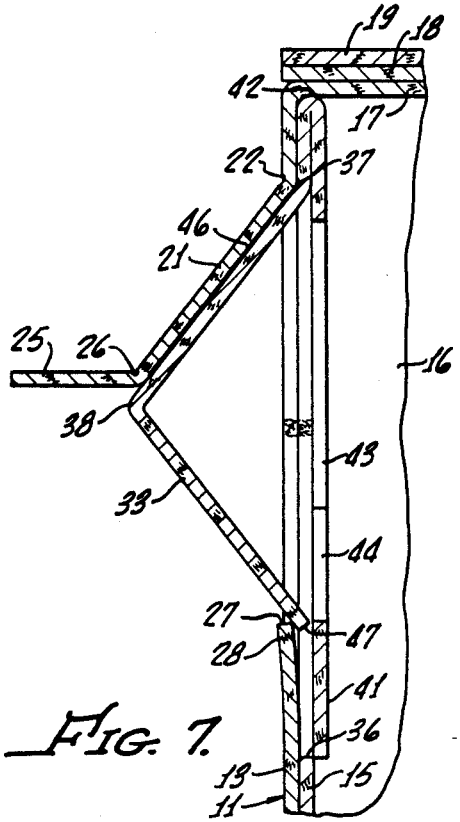
FIG. 7 is a view similar to FIG. 6 with the spout partially open.
Figure 8:
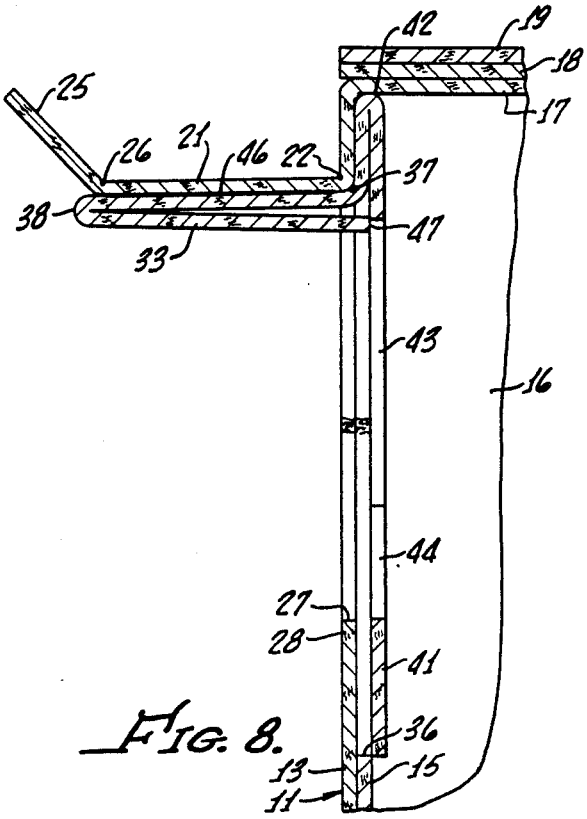
FIG. 8 is a view similar to FIGS. 6 and 7, with the spout in the open position.

When the box is to be opened, the tab 25 is grasped at the opening 29 and pulled outwardly and upwardly. This will cause a bend at the score 26, as seen in FIG. 7, as the outer flap 21 is pivoted upwardly about this score. This also severs the uncut nicks 30 and 31 so that the flap 21 can be pulled outwardly. This also pulls outwardly on the upper portion of the inner closure flap 33 above the score 38 severing the board at the nicks 39 and 40. Because the lower edge 47 of the inner flap 33 is behind the tap 28, this flap is bent about the score 38 when its upper portion is pivoted about the score 37 in this manner. The lower edge 47 of the flap 33 is caused to move upwardly by continued movement of the flaps so that it moves past the tab 28. As the closure flaps are pulled upwardly, the opening 43 is uncovered.

The flaps 21 and 33 may be held in the opened position by inserting the lower end part of the flap 33 into the opening between the cuts 34 and 35. The end edge 47 of the flap 33 will bear against the surface of the inner flap 41 on either side of the opening 43 adjacent its upper edge, holding the spout open without further attention. In order for this to occur, the lower part of the flap 33 beneath the score 38 should be approximately equal to the length of the flap 33 above the score 38. The outward flaring of the cuts 34 and 35 beneath the score 38 causes the lower end of the flap 33 to be of slightly increased width so that it can wedge into the upper part of the opening with an interference fit and will be held frictionally.

The contents of the box 12 then can be dispensed readily through the opening 43, pouring over the V-shaped edge 44 which results in an even stream of the product from the box. The opening 43 may be made quite large to allow lumpy materials, such as detergents, to flow freely through the spout.

This spout is closed easily by rotating the closure flaps upwardly and removing the lower part 47 of the flap 33 from the space between the cuts 34 and 35. The lower flap 33 is straightened out and its bottom edge is inserted beneath the tab 27 of the outer end panel 13. The flaps then are returned to their original position. As this is done, the lower end edge 47 of the flap 33 slides along the surface of the flap 41 beneath the opening 43.

If desired, the nicks 39 and 40 may be omitted so that only the outer flap 21 is retained prior to the initial opening of the spout.

The embodiment of FIGS. 9 through 12 provides an extra layer at the area of the spout for added strength and rigidity. In this arrangement, the outer end panel 48 is provided with the outer portion 49 of the closure flap which is the same as the flap 21 of the previously described embodiment. A tab 50 is at the lower edge of the flap 49 beneath a transverse score 51. An opening 52 is below the flap 49 and provides a convex upwardly projecting tab 53 at its lower edge. The flap 49 is pivotal about a transverse score 54 at its upper edge.

The inner end panel 55 includes the inner portion 56 of the closure flap which is similar to the flap 33 in the previously described embodiment. Accordingly, the flap 56 is generally rectangular, pivotal about a score 57 at its upper edge and provided with a transverse score 58 at its mid-portion.

Projecting from the upper edge of the panel 55, beyond a transverse score 59, is a flap 60 which is bent inwardly and doubled over the inside of the end panel 55 in the completed box. The flap 60 is similar to the flap 41 of the previously described embodiment and is provided with a relatively large opening 61 through it, which is similar to the opening 43.

A longitudinal cut 63 and a transverse cut 64 in the end panel 55 result in an additional flap 65 beneath the inner closure flap 56. The flap 65 extends to the outer edge 66 of the end panel 55 and is connected to the end panel 55 by a transverse score 67 at its upper edge. An opening 68 of generally the same size as the opening 61 in the flap 60 is formed in the flap 65.

In the completed box the flap 60 is folded down over the inside of the end panel 55 and secured to it by adhesive along its side edges, and the flap 65 is doubled over the flap 60. An additional quantity of glue secures the flap 65 to the flap 60. The openings 61 and 68 then are aligned and are positioned behind the inner part 56 of the closure flap. The outer part of the closure flap 49 is secured by adhesive 69 to the inner closure flap part 56 above the transverse score 58.

The box of FIGS. 9 through 12 is opened and used in the same manner as the previously described embodiment. The outer closure flap 49 is grasped at the downwardly projecting tab 50 and this flap is lifted up, thereby pulling the inner closure flap 56 along with it. This provides communication with the interior of the container through the openings 61 and 68. The closure flaps may be held in the open position by the bottom edge 70 of the flap 56. The closure flaps are retained in the closed position by inserting the bottom edge 70 of the flap 56 beneath the tab 58 of the outer end panel 48. The bottom edge 70 of the flap 56 slides along the surface of the flap 60 as it moves to the closed position.

The four layers of cardboard provided around the spout opening in the embodiment of FIGS. 9 through 12, result in great strength and rigidity, despite the fact that a large spout opening is provided.

Figure 13:
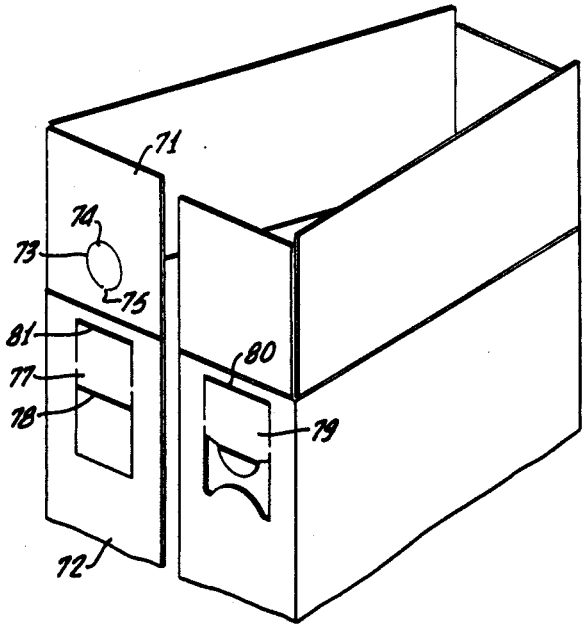
FIG. 13 is a fragmentary perspective view of a box incorporating a modified spout in a partial state of completion.
Figure 14:
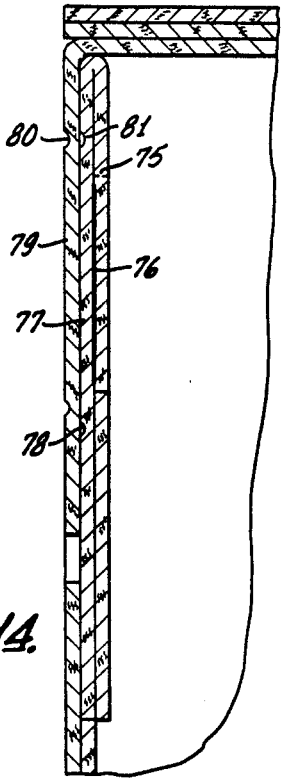
FIG. 14 is an enlarged fragmentary sectional view of the spout of FIG. 13.

In the embodiment of FIGS. 13 and 14, the flap 71 projecting from the upper edge of the inner end panel 72 is provided with a cut 73 to define a circular opening. However, the hole center 74 remains within the cut 73, held to the flap 71 by a small uncut nick 75. When the flap 71 is doubled over the inner end panel 72 the nick 75 is at the upper end, that is, at the twelve o'clock position. A quantity of glue 76 secures the inner closure flap 77 to the hole center 74 above the transverse score 78 in the inner closure flap. The remainder of the construction is the same as that of FIGS. 1 through 8.

When the outer closure flap 79 is pivoted upwardly about the score 80 at its upper edge, thereby also pivoting the inner closure flap 77 about the score 81 at its upper edge, the hole center 74 is pulled out of the cut 73, severing the nick 75. This permits the contents of the box to be dispensed. When the spout opening is to be closed by return of the closure flaps, the hole center 74 reenters the cut 73. It tends to remain in place within the cut 73 to assist in holding the closure flaps over the spout opening.

Figure 15:
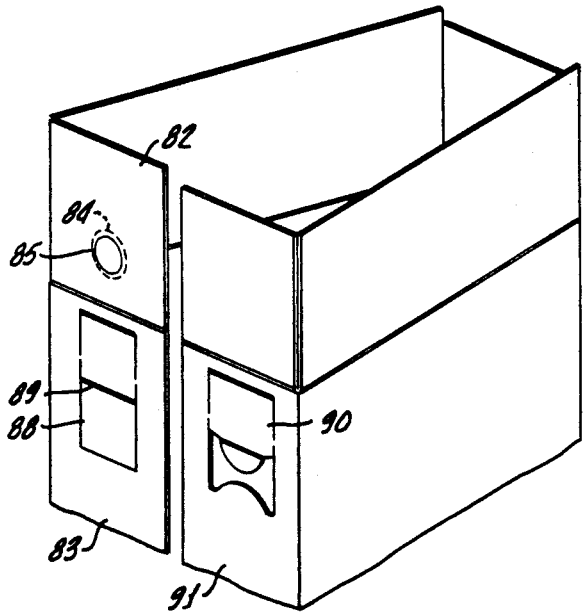
FIG. 15 is a fragmentary perspective view of a partially assembled box incorporating a waterproof or siftproof spout.
Figure 16:
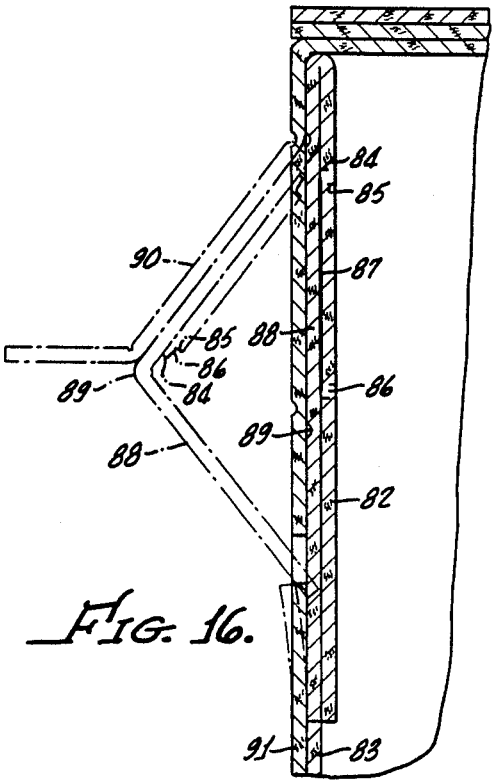
FIG. 16 is an enlarged sectional view of the spout of FIG. 15 in the completed condition.
Figure 17:
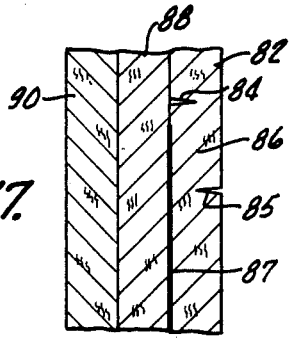
FIG. 17 is a further enlarged fragmentary view illustrating the two spaced cuts provided for the spout of FIG. 16.

According to the arrangement of FIGS. 15 through 17, the box, prior to its initial opening, may be completely sealed so that it can be made to retain fine powders or liquids without leakage. In this arrangement, the upper flap 82, which is doubled over the inside of the inner end panel 83, is provided with two partial cuts 84 and 85 from opposite sides. Thus, the cut 84 extends about half-way through the thickness of the board from one side of the flap 82 and the other cut 85 extends about half-way through from the other side of the board. These cuts define a continuous periphery which may be circular or of other shape. The cut 84 which faces the undersurface of the inner end panel 83 is made larger than the cut 85. This leaves a narrow continuous strip 86 between the cuts 84 and 85. The area within the perimeter of the cut 84 is secured by glue 87 to the inner surface of the inner closure flap 88 above the transverse score 89 in that closure flap.

When the box is opened, the outer closure flap 90 in the outer end panel 91 is pulled upwardly in the usual way. As a result, the inner closure flap 88 pulls outwardly on the portion of the flap 82 within the cut 84. This causes the flap 82 to tear at the strip 86 between the cuts 84 and 85, as shown in phantom in FIG. 16, so that the centers within these cuts are removed and a dispensing opening is provided. Until this time, however, the container is sealed because there is no cut entirely through the board at the flap 82. Therefore, there is no place for fine powders to sift through or for a liquid to leak from within the container.

The foregoing detailed description is to be clearly understood as given by way of illustration and example only, the spirit and scope of this invention being limited solely by the appended claims.

What is claimed is:

1. A box having a pouring spout comprising a cardboard structure defining a container having two side panels, a top panel, a bottom panel and two end panels, one of said panels including a first outer layer and a second layer inwardly of said first layer, said first layer including a first flap pivotal about one edge thereof said second layer including a second flap pivotal about one edge thereof, said second flap including means for permitting bending of said second flap at a location spaced from said one edge thereof, said first flap overlying and being secured to said second flap between said one edge of said second flap and said location, said structure including a third layer inwardly of said second layer, said first layer including a portion overlying a portion of said second flap, said third layer having an opening covered by said second flap, whereby to achieve an open position, said first flap is pivoted about said one edge thereof, said second flap is caused to pivot about said one edge of said second flap, said second flap is bent at said location, said portion of said second flap is withdrawn from said portion of said first layer overlying the same, and said opening in said third layer is uncovered to permit dispensing through said opening in said third layer.

2. A box having a pouring spout comprising a cardboard structure defining a container having two side panels, a top panel, a bottom panel and two end panels, one of said panels including a first outer layer and a second layer inwardly of said first layer, said first layer having a cut therein defining a first flap having an upper edge and a lower edge, and being pivotal about its upper edge relative to said first layer, said second layer having a cut therein defining a second flap having an upper and a lower edge, and being pivotal about its upper edge relative to said second layer, said second flap including means for permitting transverse bending of said second flap at a location intermediate its upper and lower edges, said first layer having a portion overlying a portion of said second flap, a quantity of adhesive securing said first flap to said second flap at a location above said means for permitting transverse bending of said second flap, said structure including a third layer inwardly of said second layer, said third layer having an opening covered by said second flap, whereby to achieve an open position said first flap is pivoted about said upper edge thereof, said second flap is caused to pivot about said upper edge of said second flap, said second flap is bent transversely intermediate the ends thereof and said portion of said second flap is withdrawn from said portion of said first layer overlying the same and said opening in said third layer is uncovered to permit dispensing through said opening in said third layer, said portion of said second flap being positionable behind said portion of said first layer for returning said first and said second flaps to a closed position.

3. A device as recited in claim 2, in which said third layer is attached to the upper end of said second layer and is doubled over said second layer.

4. A device as recited in claim 2, in which the bottom edge of said second flap when so bent transversely is engageable with said third layer adjacent the upper end of said opening in said third layer for holding said first and second flaps in said open position.

5. A device as recited in claim 4, in which said cut in said second panel includes opposed parts extending from opposite ends of said upper edge of said second flap defining side edges of said second flap, and a bottom part interconnecting said opposed parts and defining said bottom edge of said second flap, said bottom edge of said second flap being wider than said top edge thereof, whereby said bottom edge of said second flap has an interference fit between said opposed parts of said cut in said second layer when said bottom edge of said second flap so engages said third layer to assist in holding said first and second flaps in said open position.

6. A device as recited in claim 4, in which said opening in said third flap is narrower than said second flap, said bottom edge of said second flap being so engageable with said third layer on either side of said opening in said third layer.

7. A device as recited in claim 4, in which said location is approximately at the middle of said second flap between said upper edge of said second flap and the lower edge thereof.

8. A device as recited in claim 2, in which said portion of said second flap which said portion of said first layer overlies is located below said location intermediate said upper and lower edges of said second flap.

9. A device as recited in claim 2, in which said first layer includes an opening beneath said first flap, an edge portion of said opening in s id first layer providing said portion of said first layer overlying said portion of said second flap.

10. A device as recited in claim 2, in which said opening in said first layer beneath said first flap includes a bottom edge having an upwardly projecting central portion which provides said portion of said first layer overlying said portion of said second flap.

11. A device as recited in claim 2, in which said first flap includes a downwardly projecting portion unattached to said second flap and beneath said location for being grasped for so pivoting said first and second flaps.

12. A device as recited in claim 11 including means on said first flap for permitting outward bending of said downwardly projecting portion thereof.

13. A device as recited in claim 2, including at least one relatively small uncut frangible segment holding said first flap to said first layer in a closed position.

14. A device as recited in claim 2, in which said cardboard structure is scored at said upper edge of said first flap, whereby said first flap is so pivotal about its upper edge.

15. A device as recited in claim 1 in which said opening in said third layer is defined by a cut in said third layer interrupted by at least one relatively small frangible uncut segment, a portion of said third layer remaining within said cut in said third layer, and including a quantity of adhesive connecting said portion of said third layer to the underside of said second flap, whereby when said second flap is so pivoted it pulls said portion of said third layer from within said cut and severs said frangible uncut segment, and when said flaps are so returned to a closed position, said portion of said third layer is reinserted into said opening.

16. A device as recited in claim 2, in which said opening in said third layer is defined by a first cut extending partway through said third layer from one side thereof, and a second cut extending partway through said third layer from the opposite side thereof, one of said cuts in said third layer being of larger lateral dimension than the other so as to leave a relatively narrow frangible uncut strip between said cuts, and including a quantity of adhesive connecting the part within said cuts to the underside of said second flap, whereby when said second flap is so pivoted said frangible uncut strip is severed to permit dispensing through said opening, and prior to said pivoting of said second flap said opening is sealed.

17. A device as recited in claim 2, in which said sheet includes a fourth layer inwardly of said third layer, said fourth layer having an opening therethrough aligned with said opening in said third layer for dispensing therethrough.

18. A device as recited in claim 17, in which said fourth layer is attached to said second layer.

19. A box having a pouring spout comprising an integral sheet of cardboard defining a container having two side panels, a top panel, a bottom panel and two end panels, one of said end panels including a first outer layer and a second layer inwardly of said first layer, said first layer having a cut therein defining a first flap having an upper edge and being pivotal about its upper edge relative to said first layer and having an opening beneath said first flap, said opening having a bottom edge having a center portion projecting toward said first flap, said second layer having a cut therein defining a second flap having an upper edge and a lower edge, and being pivotal about its upper edge relative to said second layer, said second flap including means for permitting transverse bending of said second flap at a location intermediate its upper and lower edges, said first flap overlying said second flap, said center portion of said bottom edge overlying the bottom edge of said second flap, and a quantity of adhesive securing said first flap to said second flap above said location said sheet including a third layer inwardly of said second layer, said third layer having an opening therethrough inwardly of said first flap and said second flap, said opening in said third layer being narrower than said second flap, whereby when said first flap is pivoted about said upper edge thereof, said second flap is caused to pivot about said upper edge of said second flap and said second flap is bent transversely intermediate the upper and lower edges thereof and the bottom lower edge of said second flap is withdrawn from said center portion of said bottom edge of said opening in said first layer and can engage the surface of said third layer adjacent said opening in said third layer for supporting said first and second flaps in an open position, said lower edge of said second flap being positionable behind said center portion of said bottom edge of said opening in said first layer when said first and second flaps are returned to a closed position.

20. A device as recited in claim 19, in which said third layer is defined by a flap projecting from the upper edge of said second layer, said flap being doubled over said second layer and secured thereto.

21. A device as recited in claim 19, in which said cut in said second panel includes opposed parts extending from opposite ends of said upper edge of said second flap defining side edges of said second flap, said lower edge of said second flap being wider than the distance between said opposed parts of said cut in said second layer adjacent said upper end of said second flap, whereby said lower edge of said second flap can fit within said opposed parts of said cut in said second layer adjacent said upper edge with a press fit for holding said first flap and said second flap in an open position.

22. A device as recited in claim 19, in which said first flap includes a bottom end portion projecting downwardly, and means for permitting transverse bending of said first flap at said bottom end portion, said bottom end portion being unattached to said second flap whereby said bottom end portion can be grasped and bent outwardly for pulling said flaps upwardly about their upper edges.

23. A device as recited in claim 19, including, in addition, a fourth flap cut from said second layer beneath said second flap and folded upwardly to a position inside of said second layer, said fourth flap having an opening therethrough in registry with said opening in said third layer.

* * * * *